US012765596B2

(12) United States Patent
Zhao et al.

(10) Patent No.: US 12,765,596 B2
(45) Date of Patent: Oct. 20, 2026

(54) HEATER AND LOW-TEMPERATURE BAKING SMOKING SET

(71) Applicant: SHENZHEN FIRST UNION TECHNOLOGY CO., LTD., Shenzhen (CN)

(72) Inventors: Hengkun Zhao, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 662 days.

(21) Appl. No.: 17/438,516

(22) PCT Filed: Mar. 13, 2020

(86) PCT No.: PCT/CN2020/079268
§ 371 (c)(1),
(2) Date: Sep. 13, 2021

(87) PCT Pub. No.: WO2020/182215
PCT Pub. Date: Sep. 17, 2020

(65) Prior Publication Data

US 2022/0142252 A1 May 12, 2022

(30) Foreign Application Priority Data

Mar. 14, 2019 (CN) ..... 201920329108.3

(51) Int. Cl.
*A24F 40/46* (2020.01)
*A24F 40/51* (2020.01)
*A24F 40/57* (2020.01)

(52) U.S. Cl.
CPC ..... *A24F 40/46* (2020.01); *A24F 40/51* (2020.01); *A24F 40/57* (2020.01)

(58) Field of Classification Search
CPC ..... A24F 40/46
See application file for complete search history.

(56) References Cited

FOREIGN PATENT DOCUMENTS

CN 205695291 U 11/2016
CN 106942792 A * 7/2017
(Continued)

OTHER PUBLICATIONS

CN-106942792-A, generated by PE2E search, English machine translation 2017.*
(Continued)

*Primary Examiner* — Russell E Sparks
*Assistant Examiner* — Michael T Fulton
(74) *Attorney, Agent, or Firm* — Proi Intellectual Property US

(57) ABSTRACT

The present disclosure relates to the field of smoking sets. Provided are a heater and a low-temperature baking smoking set comprising the heater. The heater comprises: a bracket, wherein a heating chamber accommodating a cigarette is provided in the bracket; a heating body, wherein the heating body comprises a heating part and a fixing part, the heating part extends from the fixing part along the longitudinal direction of the bracket, and the heating part is exposed in the heating chamber for being inserted into the cigarette to heat the cigarette; and a fixing seat, wherein the fixing seat is connected to the bracket, and the fixing seat abuts against the fixing part so as to fix the heating body on the bracket.

16 Claims, 9 Drawing Sheets

(56) References Cited

FOREIGN PATENT DOCUMENTS

| | | | | |
|---|---|---|---|---|
| CN | 206949531 | U | | 2/2018 |
| CN | 207011682 | U | * | 2/2018 |
| CN | 208129448 | U | | 11/2018 |
| CN | 109007984 | A | | 12/2018 |
| CN | 209931482 | U | | 1/2020 |
| WO | 2018190607 | A2 | | 10/2018 |
| WO | 20180217054 | A | | 11/2018 |

OTHER PUBLICATIONS

CN-207011682-U, English machine translation generated by EPO, 2018.*

* cited by examiner

HEATER AND LOW-TEMPERATURE BAKING SMOKING SET

TECHNICAL FIELD

The embodiment of the present disclosure relates to the field of smoking sets, in particular to a heater and a low-temperature baking smoking set comprising the same.

BACKGROUND

Cigarettes, as a hobby, are loved by many people. However, tar, carbon monoxide and other substances in cigarettes are harmful to human health. Especially, tar contains more than ten carcinogens, which greatly affects human health. At present, governments of various countries have gradually stipulated that cigarette (cigar) smoking is prohibited in public places. However, smokers who are addicted to cigarettes cannot completely quit cigarette smoking. Therefore, many substitutes of simulated cigarettes, such as smoking cessation tablets and electronic cigarettes, have appeared in the market.

In recent years, a non-burning low-temperature baking smoking set appears in electronic cigarettes, which produces smoke by baking cigarettes at low temperature and greatly reduces the generation of harmful substances. The existing low-temperature baking smoking set generally comprises a shell, a power supply unit and a heater, wherein the power supply unit supplies electric energy to the heater, so that the heater heats cigarettes to generate smoke. The heater generally comprises a hollow cylindrical bracket, a heating body and a fixing seat. The inside of the bracket is provided with a heating chamber for receiving cigarettes. The cigarettes are inserted into the bracket from one end of the bracket, and the heating body is fixed on the fixing seat. The heating body extends into the heating chamber from the other end of the bracket, so as to be inserted into the cigarette for baking the cigarette.

As shown in FIG. 1, in the existing low-temperature baking smoking set, the left fixing seat and the right fixing seat are buckled with each other along the longitudinal direction of the bracket to clamp and fix the heating body. Due to the manufacturing tolerance, the heating body tilts and is not centered to a certain extent after the left fixing seat, the right fixing seat, and the heating body are assembled, such that the cigarette is not uniformly heated by the heating body during heating and baking, thereby affecting the smoking amount.

SUMMARY

In order to solve the problem that the heating body tilts and is not centered in the prior art, the present disclosure provides a heater with the heating body not easily tilting and a low-temperature baking smoking set comprising the heater.

In a first aspect, the present disclosure provides a heater, comprising:

- a bracket, wherein a heating chamber accommodating a cigarette is provided in the bracket;
- a heating body, wherein the heating body comprises a heating part and a fixing part, the heating part extends from the fixing part along the longitudinal direction of the bracket, and the heating part is exposed in the heating chamber for being inserted into the cigarette to heat the cigarette; and

- a fixing seat, wherein the fixing seat is connected to the bracket, and the fixing seat abuts against the fixing part so as to fix the heating body on the bracket.

Preferably, the fixing seat comprises a first fixing seat and a second fixing seat, the first fixing seat comprises a first body, the second fixing seat comprises a second boss, and the fixing part is clamped between the first body and the second boss.

Preferably, an accommodating groove is concavely provided from the surface where the second boss is attached to the fixing part toward the direction away from the fixing part, the heater further comprises a temperature sensor provided in the accommodating groove, and the temperature sensor is in contact with the fixing part for detecting the real-time temperature of the heating body.

Preferably, the fixing part is flat, and the plate surface of the fixing part is perpendicular to the longitudinal direction of the bracket.

Preferably, a partition wall is provided inside the bracket, the first body is clamped between the partition wall and the second boss, at least one clamping groove is provided on the outer side of the bracket, the second fixing seat further comprises a second body, and at least one clamping protrusion matched with the clamping groove is convexly provided on the outer side of the second body.

Preferably, the second body is concavely provided with an annular receiving groove, the receiving groove surrounds the second boss, the first fixing seat further comprises a first cylinder extending from the first body toward the second body, and the lower end of the first cylinder is received in the receiving groove.

Preferably, the second boss is received in the first cylinder, a second guide column extending along the longitudinal direction of the bracket is convexly provided on the outer side of the second boss, and a second guide groove matched with the second guide column is concavely provided on the inner side of the first cylinder.

Preferably, an annular sealing groove is concavely provided on the end face of the first body abutting against the partition wall, the heater further comprises a sealing ring, and the sealing ring is received in the sealing groove.

Preferably, a first limiting part and a second limiting part which are ring-shaped are convexly provided on the outer side of the bracket, and the heater further comprises a coil positioned between the first limiting part and the second limiting part.

In a second aspect, the present disclosure provides a low-temperature baking smoking set, comprising:

- a housing;
- a heater, which is received in the housing;
- a power supply unit, which is received in the housing, wherein the power supply unit is mainly configured to supply electric energy to the heater for heating and baking the cigarette received in the heater;
- wherein the heater is the heater described above.

Compared with the prior art, the fixing seat is connected to the bracket, and the fixing part of the heating body is provided on the fixing seat, so as to avoid the problem that the heating body tilts and is not centered, such that the cigarette is uniformly baked by the heating body, thereby ensuring the smoking amount.

Compared with the prior art, the fixing seat is connected to the bracket, and the fixing seat abuts against the fixing part of the heating body to fix the heating body on the bracket, so as to avoid the problem that the heating body tilts and is not centered, such that the cigarette is uniformly baked by the heating body, thereby ensuring the smoking amount.

BRIEF DESCRIPTION OF THE DRAWINGS

One or more embodiments are illustrated by the figures in the corresponding drawings, which do not constitute a limitation of the embodiments. Elements with the same reference numerals in the drawings are represented as similar elements. Unless otherwise stated, the figures in the drawings do not constitute a scale limitation.

DESCRIPTION OF THE REFERENCE NUMBERS OF THE DETAILED DESCRIPTION

Figure 1:
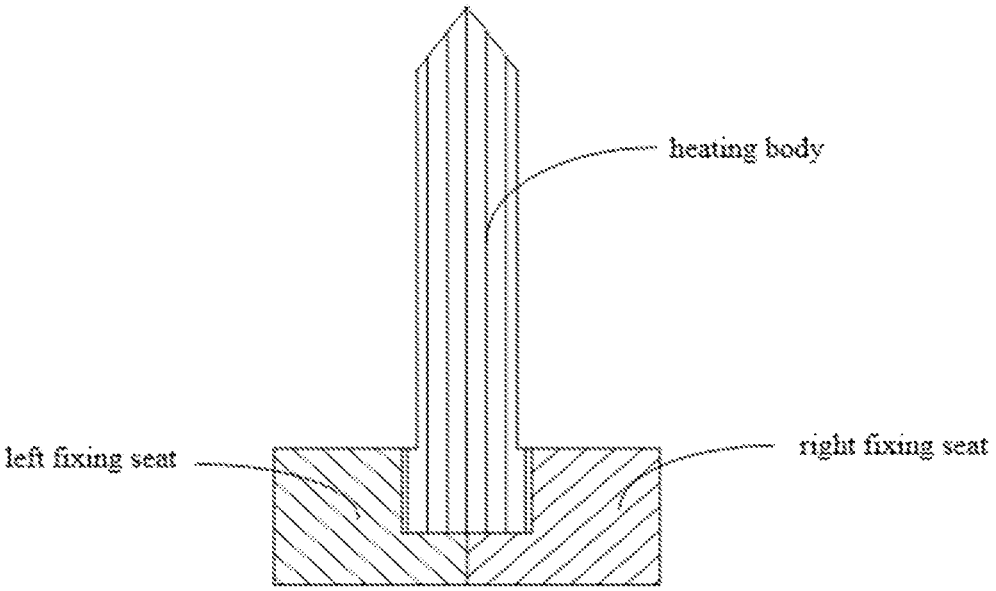
FIG. 1 is a schematic diagram of components of a left fixing seat, a fixing seat and a heating body in the prior art.

| | | | |
|---|---|---|---|
| Housing 100 | heater 200 | bracket 1 | heating chamber 10 |
| first limiting part 11 | second limiting part 12 | Clamping groove 13 | partition wall 14 |
| first through hole 140 | first guide column 15 | heating body 2 | fixing part 21 |
| heating part 22 | fixing seat 3 | first fixing seat 31 | first body 311 |
| second through hole 3110 | sealing groove 3111 | first cylinder 312 | first guide groove 3120 |
| second guide groove 3121 | second fixing seat 32 | second body 321 | clamping protrusion 3211 |
| receiving groove 3212 | second boss 322 | accommodating groove 3221 | second guiding column 3222 |
| temperature sensor 4 | sealing ring 5 | coil 6 | cigarette holder 7 |
| power supply unit 300 | control assembly 400 | cigarette 500 | |

DETAILED DESCRIPTION

In order to facilitate the understanding of the present disclosure, the present disclosure will be described in more detail with reference to the drawings and specific embodiments. It should be noted that when an element is expressed to be "fixed" to another element, it may be directly on the other element, or there may be one or more intermediate elements therebetween. When an element is expressed to be "connected" to another element, it may be directly connected to another element, or there may be one or more intermediate elements therebetween. The terms "upper", "lower", "left", "right", "inner", "outer" and similar expressions used in this specification are for the purpose of illustration only.

Unless otherwise defined, all technical and scientific terms used in this specification have the same meanings as those commonly understood by those skilled in the art of the present disclosure. Terms used in this specification of the present disclosure are only for the purpose of describing specific embodiments, rather than limit the present disclosure. As used in this specification, the term "and/or" comprises any and all combinations of one or more related listed items.

Figure 2:
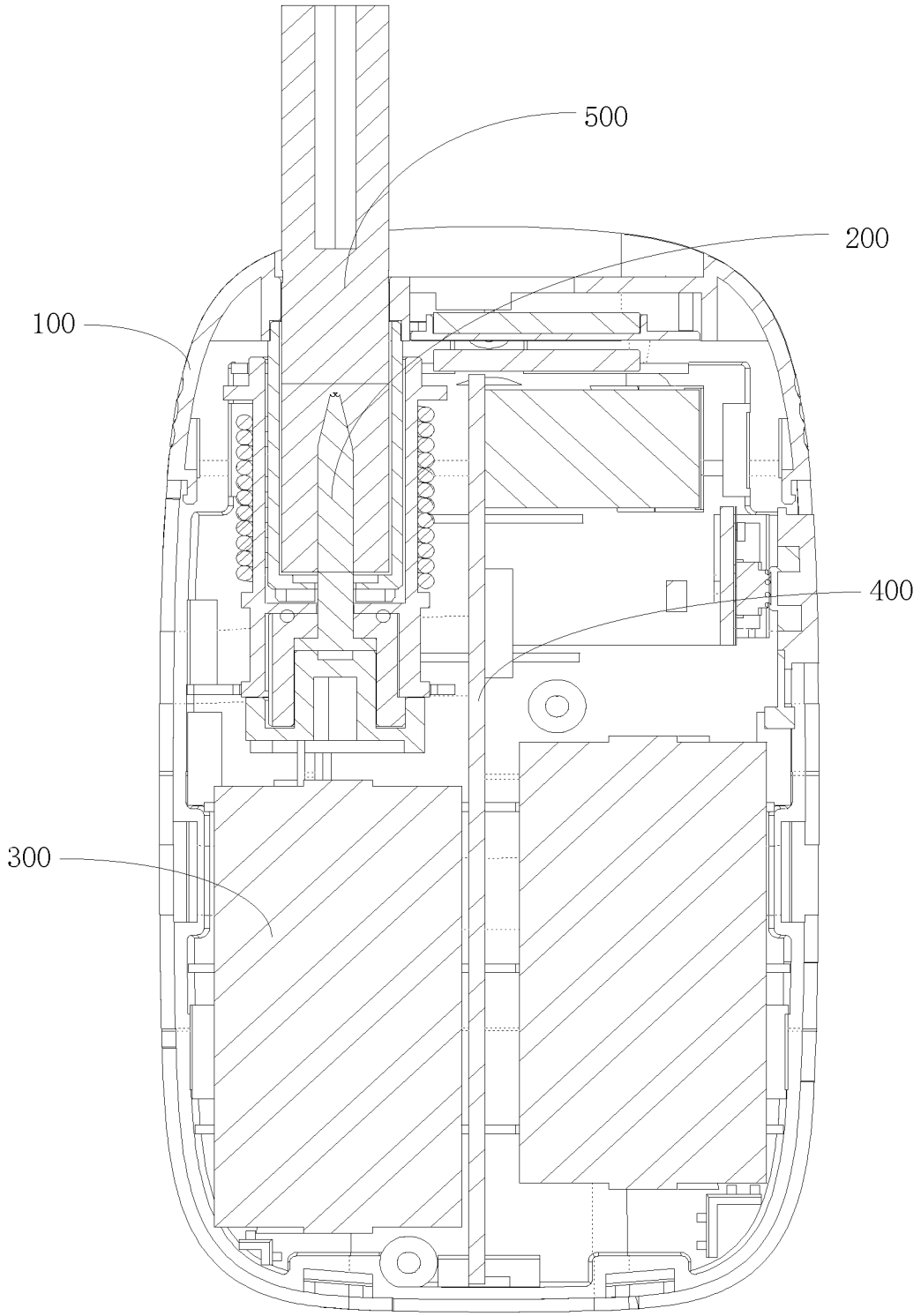
FIG. 2 is a cross-sectional diagram of a low-temperature baking smoking set according to one embodiment of the present disclosure.

As shown in FIG. 2, the low-temperature baking smoking set according to one embodiment of the present disclosure mainly comprises a housing 100, a heater 200, a power supply unit 300 and a control assembly 400.

The housing 100 is used to support, fix and protect the heater 200, the power supply unit 300 and the control assembly 400.

Figure 3:
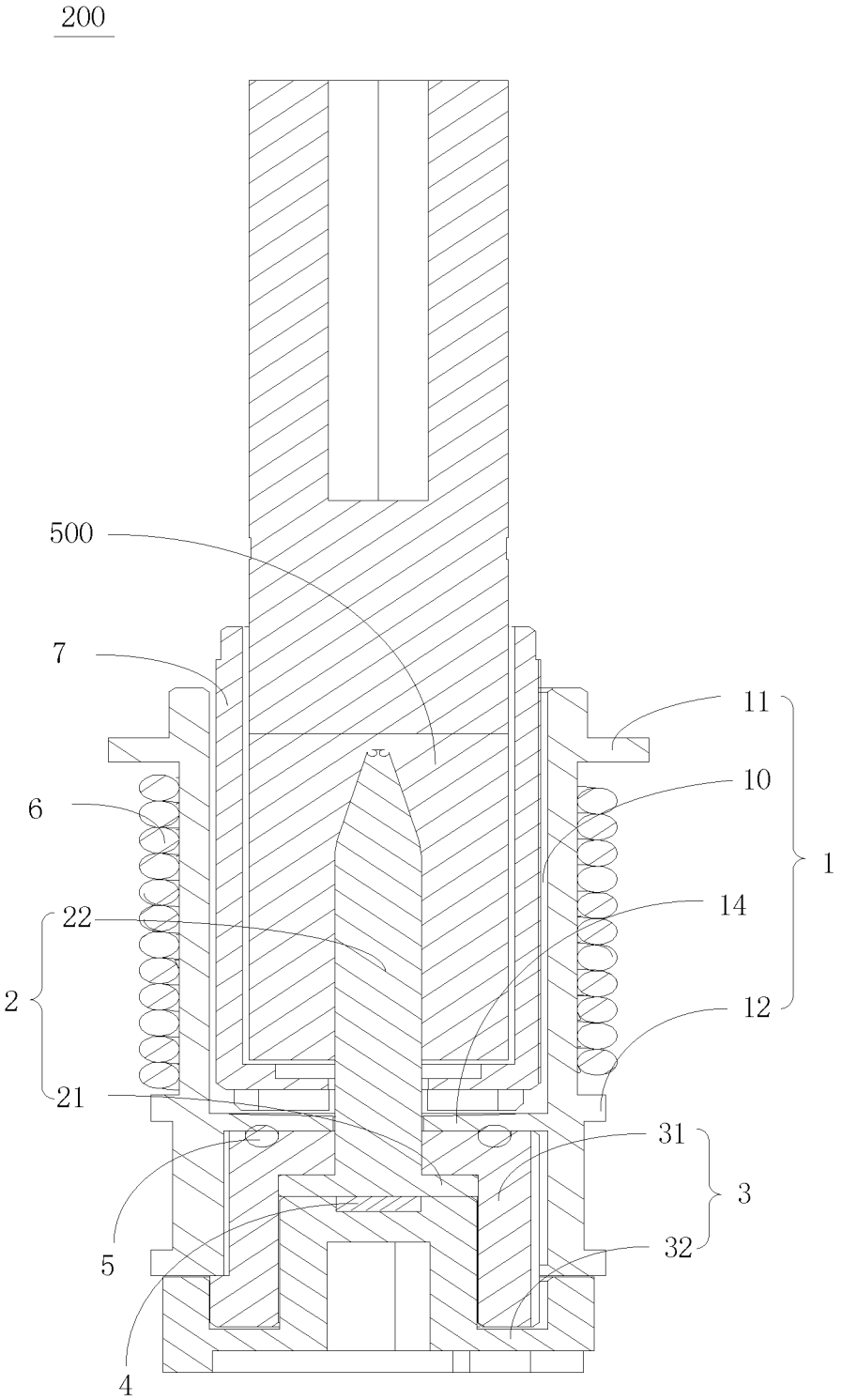
FIG. 3 is a plan cross-sectional diagram of a heater according to one embodiment.

As shown in FIGS. 2 and 3, the heater 200 mainly comprises a bracket 1, a heating body 2, a fixing seat 3, a temperature sensor 4, a coil 6, a sealing ring 5, and a cigarette holder 7.

Figure 4:
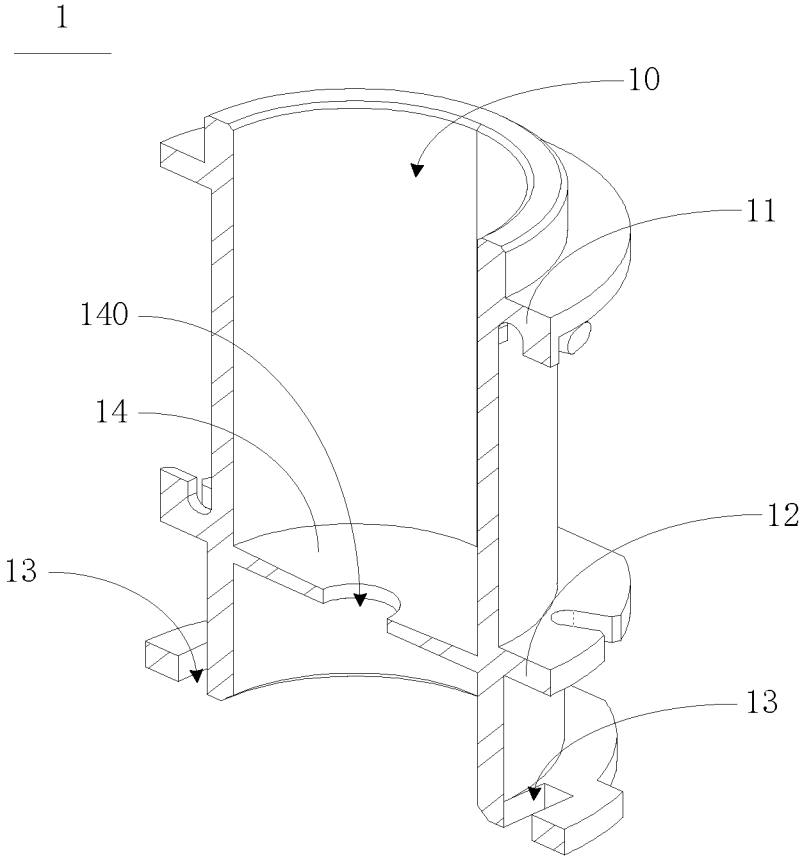
FIG. 4 is a perspective cross-sectional diagram of a bracket of a heater according to one embodiment.
Figure 5:
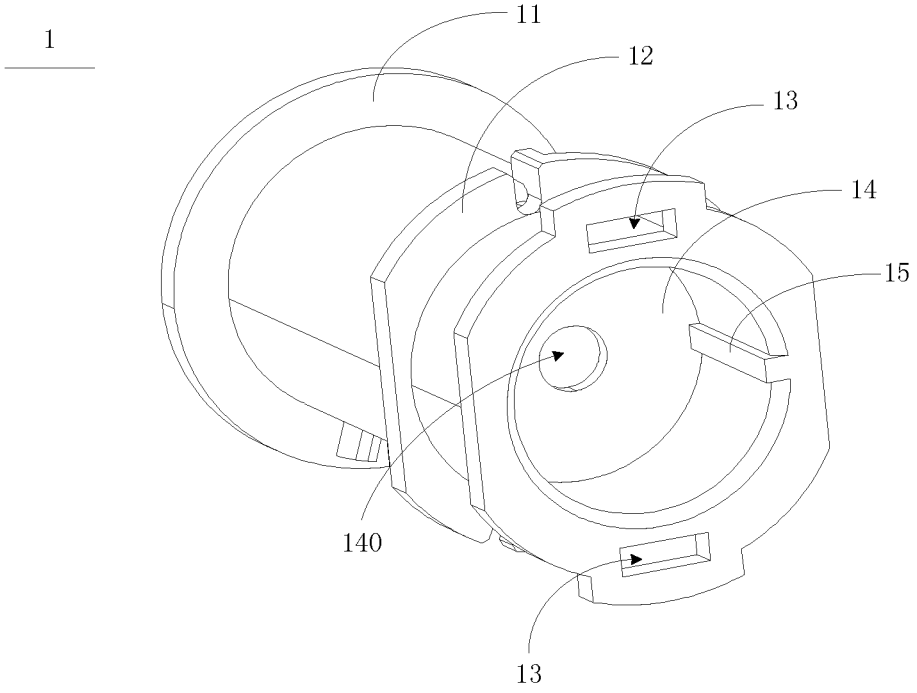
FIG. 5 is a perspective diagram of a bracket of a heater according to one embodiment.

As shown in FIG. 3 to FIG. 5, the bracket 1 has a generally hollow cylindrical longitudinal structure, and a heating chamber 10 for receiving cigarette 500 is provided inside the bracket 1. A first limiting part 11 and a second limiting part 12 which are ring-shaped in the circumferential direction are convexly provided on the outer side of the bracket 1 at intervals. The first limiting part 11 is located at the upper end of the bracket 1, and the second limiting part 12 is located below the central horizontal plane of the bracket 1. The outer side of the bracket 1 is provided with two clamping grooves 13, which are symmetrically provided on the bracket 1. The two clamping grooves 13 are located below the second limiting part 12. A partition wall 14 extends radially from the inner side of the bracket 1. A heating chamber 10 is located above the partition wall 14, and a first through hole 140 penetrating through the upper and lower sides of the partition wall 14 is provided in the center of the partition wall 14. A first guide column 15 is convexly provided between the inner lower surface of the bracket 1 and the partition wall 14, and the first guide column 15 extends along the longitudinal direction of the bracket 1.

The bracket 1 is made of a hard plastic material which is non-conductive and excellent in heat insulation effect. The bracket 1 can be made of at least one of related plastics made of phenolic plastics, polyurethane plastics, epoxy plastics, unsaturated polyester plastics, furan plastics, silicone resins, acrylic resins and their modified resins as the organism.

Figure 6:
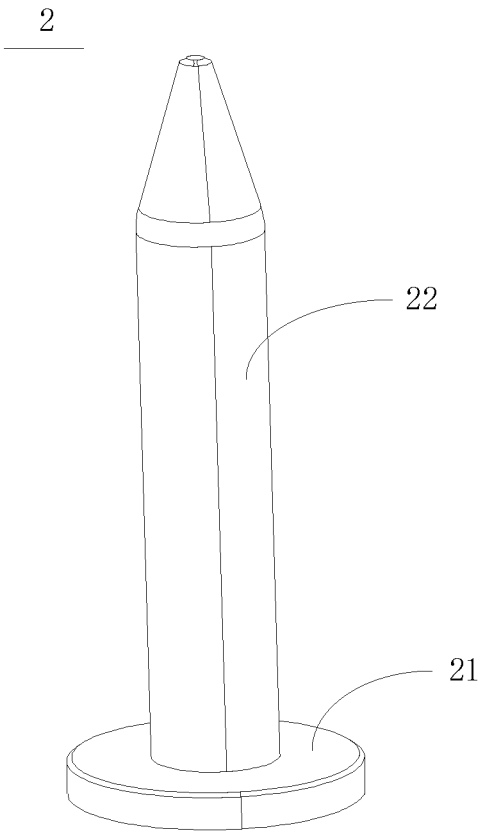
FIG. 6 is a perspective diagram of a heating body of a heater according to one embodiment.

As shown in FIGS. 3 and 6, the heating body 2 comprises a fixing part 21 and a heating part 22. The fixing part 21 is flat. The plate surface of the fixing part 21 is perpendicular to the longitudinal direction of the bracket 1. The upper surface of the fixing part 21 abuts against the lower surface of the first body 311. The heating part 22 extends from the center of the fixing part 21 along the longitudinal direction of the bracket 1. The outer peripheral diameter of the heating part 22 is smaller than that of the fixing part 21. An end of the heating part 22 away from the fixing part 21 is tapered, which is beneficial for the heating part 22 to be inserted into the cigarette 500. In this embodiment, the heating part 22 has a rod-shaped structure with a circular cross section. It can be understood that in some other embodiments, the cross section of the heating part 22 can also be triangular, oval or other shapes.

The heating body 2 is made of ferromagnetic material, that is, iron and iron alloy, cobalt and cobalt alloy or nickel and nickel alloy. The heating body 2 generates heat in the changing magnetic field, thereby heating and baking the cigarette 500.

Figure 7:
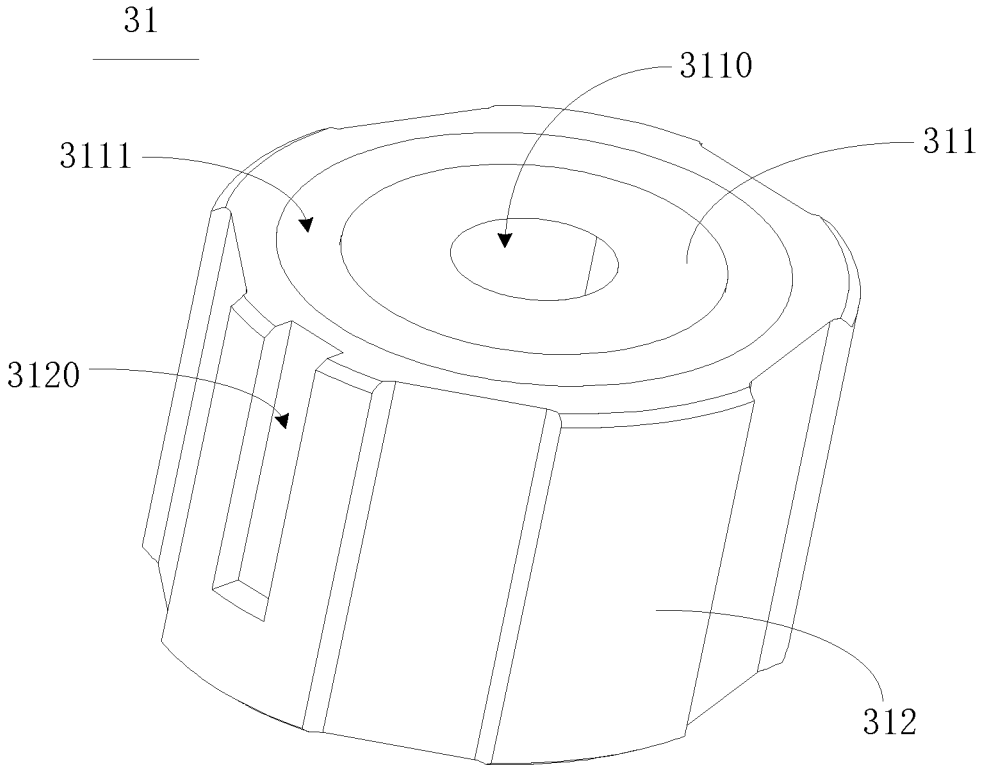
FIG. 7 is a perspective diagram of a first fixing seat of a heater according to one embodiment from an angle of view.
Figure 8:
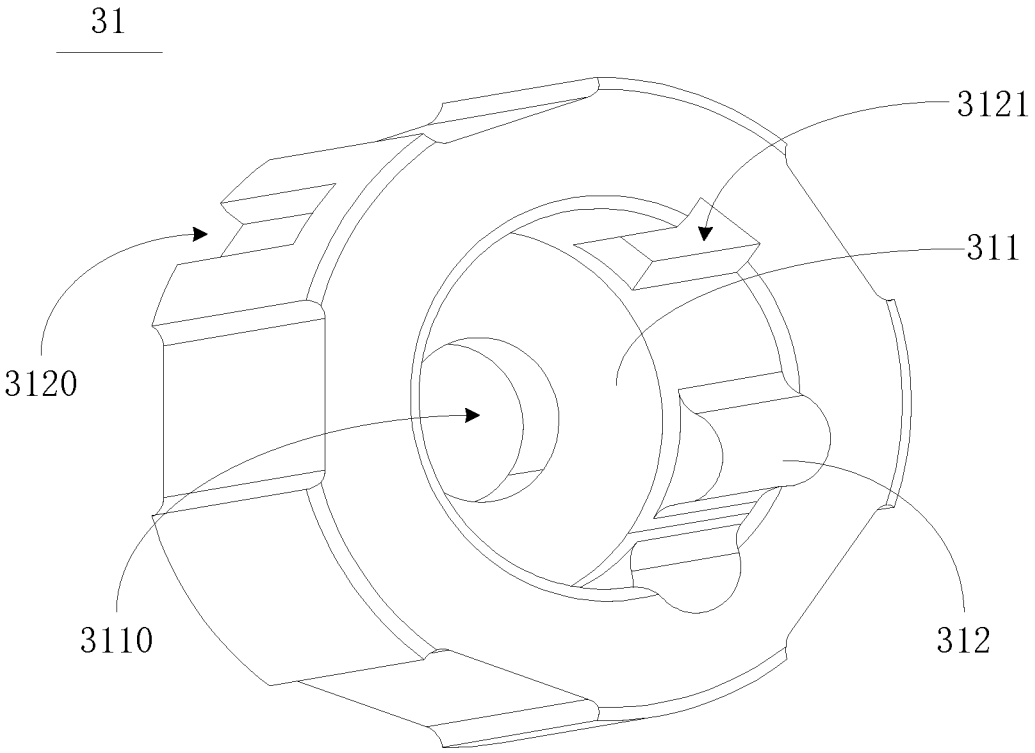
FIG. 8 is a perspective diagram of a first fixing seat of a heater according to one embodiment from another angle of view.

As shown in FIGS. 3, 7 and 8, the fixing seat 3 comprises a first fixing seat 31 and a second fixing seat 32. The first fixing seat 31 comprises a first body 311 and a first cylinder 312. The first body 311 is generally flat. The center of the first body 311 is provided with a second through hole 3110 penetrating through the upper and lower sides of the first body 311. The upper surface of the first body 311 is concavely provided with an annular sealing groove 3111. The sealing groove 3111 surrounds the second through hole 3110. The upper surface of the first body 311 abuts against the lower surface of the partition wall 14.

The first cylinder 312 extends downward from the lower surface of the first body 311. A first guide groove 3120 is concavely provided on the outer side of the first cylinder 312. The first guide groove 3120 extends downward from the upper end of the first cylinder along the longitudinal direction of the bracket 1. The first guide groove 3120 is matched with the first guide column 15. On the one hand, the guiding function can be realized when the first fixing seat 31 is inserted into the bracket 1; on the other hand, the circumferential fixing between the first fixing seat 31 and the bracket 1 can be realized, thus avoiding the relative rotation between the first fixing seat 31 and the bracket 1. The inner wall of the first cylinder 312 is concavely provided with a second guide groove 3121. The second guide groove 3121 extends upward from the lower end of the first cylinder 312 along the longitudinal direction of the bracket 1. Most of the first body 311 and the first cylinder 312 are received in the lower end of the bracket 1.

Figure 9:
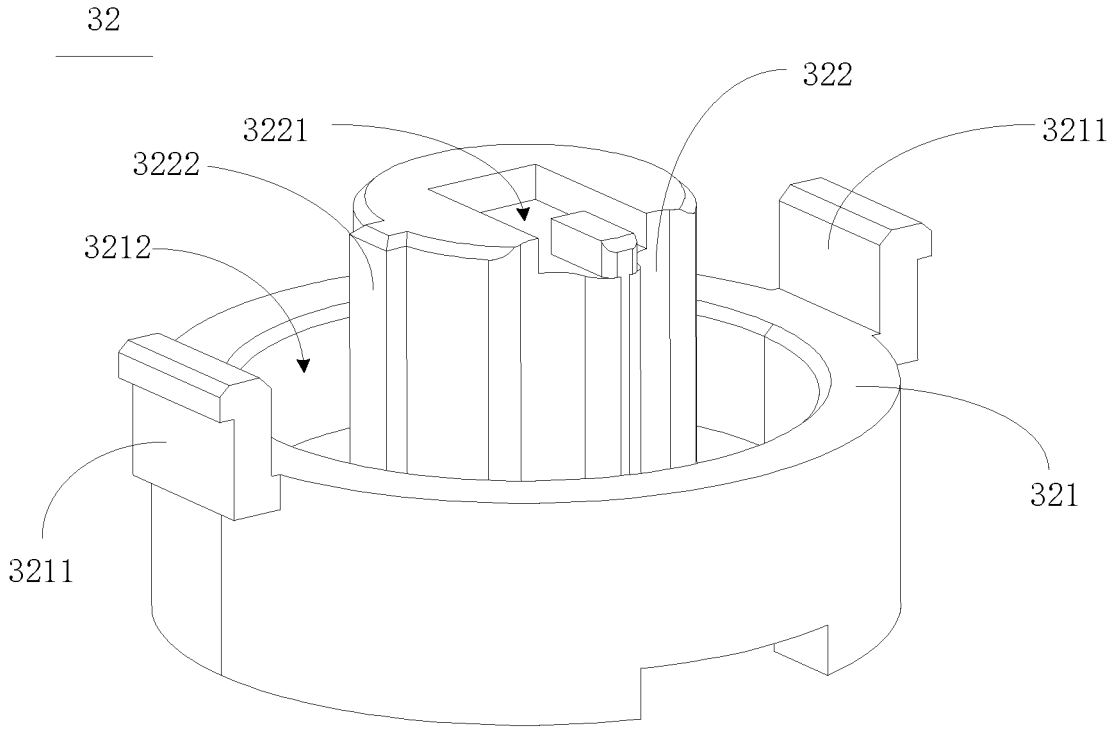
FIG. 9 is a perspective diagram of a second fixing seat of a heater according to one embodiment.

As shown in FIG. 3 and FIG. 9, the second fixing seat 32 comprises a second body 321 and a second boss 322. Two clamping protrusions 3211 are convexly provided on the outer side of the second fixing base 32. The two clamping protrusions 3211 are symmetrically provided on the second body 321. The two clamping protrusions 3211 are matched with the two clamping grooves 13, respectively, so that the second fixing base 32 is fixedly connected to the bracket 1. The upper surface of the second fixing base 32 abuts against the lower end surface of the bracket 1, and an annular receiving groove 3212 is concavely provided downward on the upper surface of the second fixing base 32. The lower end of the first cylinder 312 is received in the receiving groove 3212.

The second boss 322 extends upward from the center of the upper surface of the second fixing seat 32 along the longitudinal direction of the bracket 1. An accommodating groove 3221 is concavely provided downward on the upper surface of the second boss 322, and the upper surface of the second boss 322 abuts against the lower surface of the fixing part 21, so that the fixing part 21 is clamped and fixed between the second boss 322 and the first body 311. A second guide column 3222 is convexly provided at the side of the second boss 322. The second guide column 3222 extends downward from the upper end of the second boss 322 along the longitudinal direction of the bracket 1. The second guide column 3222 is matched with the second guide groove 3121 on the first cylinder 312. On the one hand, the guiding function can be realized when the second boss 322 is inserted into the first cylinder 312; on the other hand, the circumferential fixing between the second fixing base 32 and the first fixing seat 31 can be realized, thus avoiding the relative rotation between the second fixing base 32 and the first fixing seat 31.

The first fixing seat 31 and the second fixing seat 32 are made of hard plastic materials which are non-conductive and excellent in heat insulation effect. The bracket 1 can be made of at least one of related plastics made of phenolic plastics, polyurethane plastics, epoxy plastics, unsaturated polyester plastics, furan plastics, silicone resins, acrylic resins and their modified resins as the organism.

The temperature sensor 4 is located in the accommodating groove 3221 of the second boss 322, and the temperature sensor 4 is attached to the lower end surface of the fixing part 21 of the heating body 2 for detecting the real-time temperature of the heating body 2.

The sealing ring 5 is made of high-temperature resistant silica gel or rubber material. The sealing ring 5 is annular. The sealing ring 5 is received in the sealing groove 3111 for sealing the first body 311 and the partition wall 14, so as to prevent the tobacco tar produced by the heating chamber 10 from leaking through the gap between the partition wall 14 and the second body 321.

The coil 6 is located between the first limiting part 11 and the second limiting part 12. There are a plurality of turns of coil 6. The plurality of turns of coil 6 surround the bracket 1 in the same direction. For example, the plurality of turns of coil 6 can surround the bracket 1 clockwise or counter-clockwise. In the longitudinal direction of the bracket 1, the coil 6 and the heating part 22 of the heating body 2 mostly overlap.

The cigarette holder 7 is received in the heating chamber 10 for carrying cigarette 500. A through hole is provided at the lower end of the cigarette holder 7 into which the heating part 22 of the heating body 2 is inserted.

As shown in FIG. 2, the power supply unit 300 is a rechargeable battery, which is mainly used for supplying electric energy to the heater 200.

The control assembly 400 is electrically connected to the temperature sensor 4, the power supply unit 300 and the coil 6, respectively. After the user clicks the switch button (not shown), the power supply unit 300 and the coil 6 are electrically communicated, and the control assembly 400 controls the coil 6 to be fed with a changing alternating current, so that the heating part 22 of the heating body 2 performs induction-heating. The temperature sensor 4 transmits the detected real-time temperature signal of the heating body 2 to the control assembly 400. The control assembly 400 controls the magnitude of the current fed into the coil 6 and the magnitude of the conversion frequency of the current flow direction according to the real-time temperature signal.

When the heater 200 is assembled, first, the heating part 22 of the heating body 2 can pass through the first fixing hole on the first fixing seat 31. Then, the temperature sensor 4 is accommodated in the accommodating groove 3221 of the second fixing seat 32. Then, the second guide column 3222 on the second boss 322 aligns with the second guide groove 3121 on the first cylinder 312, and the second boss 322 is inserted into the first cylinder 312. Then, the heating part 22 passes through the first through hole 140 of the partition wall 14, and the second fixing seat 32 is pushed upward, so that the clamping protrusion 3211 on the second fixing seat 32 is buckled and fixed in the clamping groove 13 of the bracket 1. Then, the coil 6 is fixed between the first limiting part 11 and the second limiting part 12. Finally, the cigarette holder 7 is put into the heating chamber 10 from the upper end, thus completing the assembly and fixing of the heater 200.

In this embodiment, the fixing seat 3 is connected to the bracket 1. The fixing seat 3 abuts against the fixing part 21 of the heating body 2 to fix the heating body 2 on the bracket 1, thus avoiding the problem that the heating body 2 tilts and is not centered, such that the cigarette 500 is uniformly baked by the heating body 2, thereby ensuring the smoking amount.

It can be understood that in this embodiment, the structure of fixing the heating body 2 by the cooperation of the first fixing seat 31 and the second fixing seat 32 is not only applicable to the heater 200 in the electromagnetic heating mode, but also applicable to the heater 200 in the resistance heating mode.

It should be noted that preferred embodiments of the present disclosure are given in the specification and drawings of the present disclosure. However, the present disclosure can be realized in many different forms, without being limited to the embodiments described in this specification. These embodiments are not taken as additional limitations on the content of the present disclosure. The purpose of providing these embodiments is to make the understanding of the content of the present disclosure more thorough and comprehensive. In addition, the above technical features continue to be combined with each other to form various embodiments not listed above, which are regarded as the scope described in the specification of the present disclosure. Further, for those skilled in the art, improvements or transformations can be made according to the above description, and all these improvements and transformations should belong to the protection scope of the appended claims of the present disclosure.

The invention claimed is:

1. A heater, comprising:

a bracket, wherein a heating chamber for accommodating a cigarette is provided in the bracket, the bracket having a generally hollow cylindrical structure extending in a longitudinal direction, and a partition wall extending radially from an inner side of the bracket and having an upper side and a lower side, wherein the partition wall separates the heating chamber from a fixing seat compartment that is in the longitudinal direction opposite to the heating chamber and formed by the lower side of the partition wall and the inner side of the bracket, wherein a first through hole is provided in a center of the partition wall that extends through the upper and lower sides of the partition wall;

a heating body, wherein the heating body comprises a heating part and a fixing part, the heating part extends from an upper surface of the fixing part along the longitudinal direction of the bracket, wherein the fixing part has a lower surface that is along the longitudinal direction opposite to the upper surface and wherein the heating part extends through the first through hole and is exposed in the heating chamber for being inserted into the cigarette to heat the cigarette; and a fixing seat, wherein the fixing seat is connected to the bracket and arranged within the fixing seat compartment, wherein the fixing seat contacts the lower side of the partition wall, and the fixing seat abuts against the fixing part so as to fix the heating body on the bracket, wherein a second through hole is provided in the fixing seat and wherein the heating part extends through the second through hole which is aligned with the first through hole;

wherein the fixing seat comprises a first fixing seat and a second fixing seat, the first fixing seat comprises a first body and a first cylinder, the second fixing seat comprises a second body and a second boss, wherein the second boss of the second fixing seat extends upward from an upper surface of the second fixing seat along the longitudinal direction of the bracket, wherein the first cylinder extends from the first body in the longitudinal direction toward the second body, wherein the second boss is received in the first cylinder, and wherein the fixing part of the heating body is clamped between the first body and the second boss of the fixing seat, wherein a lower surface of the first body within the first cylinder abuts against the upper surface of the fixing part and an upper surface of the second boss abuts against the lower surface of the fixing part, wherein the second through hole is provided in the first body.

2. The heater according to claim 1, wherein an accommodating groove is concavely provided from the surface where the second boss is attached to the fixing part toward the direction away from the fixing part, the heater further comprises a temperature sensor provided in the accommodating groove, and the temperature sensor is in contact with the fixing part for detecting the real-time temperature of the heating body.

3. The heater according to claim 1, wherein the fixing part is flat, and the plate surface of the fixing part is perpendicular to the longitudinal direction of the bracket.

4. The heater according to claim 1, wherein the first body is clamped between the partition wall and the second boss, at least one clamping groove is provided on the outer side of the bracket, wherein at least one clamping protrusion matched with the clamping groove is convexly provided on the outer side of the second body.

5. The heater according to claim 4, wherein the second body is concavely provided with an annular receiving groove, the receiving groove surrounds the second boss, wherein a lower end of the first cylinder is received in the receiving groove.

6. The heater according to claim 5, wherein a second guide column extending along the longitudinal direction of the bracket is convexly provided on the outer side of the second boss, and a second guide groove matched with the second guide column is concavely provided on the inner side of the first cylinder.

7. The heater according to claim 4, wherein an annular sealing groove is concavely provided on an end face of the first body abutting against the partition wall, the heater further comprises a sealing ring, and the sealing ring is received in the annular sealing groove.

8. The heater according to claim 2, wherein a first limiting part and a second limiting part which are ring-shaped are convexly provided on the outer side of the bracket, and the heater further comprises a coil positioned between the first limiting part and the second limiting part.

9. A low-temperature baking smoking set, comprising:

a housing;

a heater, which is received in the housing;

a power supply unit, which is received in the housing, wherein the power supply unit is mainly configured to supply electric energy to the heater for heating and baking the cigarette received in the heater;

wherein the heater comprises:

a bracket, wherein a heating chamber for accommodating a cigarette is provided in the bracket, the bracket having a generally hollow cylindrical structure extending in a longitudinal direction, and a partition wall extending radially from an inner side of the bracket and having an upper side and a lower side, wherein the partition wall separates the heating chamber from a fixing seat compartment that is in the longitudinal direction opposite to the heating chamber and formed by the lower side of the partition wall and the inner side of the bracket, wherein a first through hole is provided in a center of the partition wall that extends through the upper and lower sides of the partition wall;

a heating body, wherein the heating body comprises a heating part and a fixing part, the heating part extends from an upper surface of the fixing part along the longitudinal direction of the bracket, wherein the fixing part has a lower surface that is along the longitudinal direction opposite to the upper surface and wherein the heating part extends through the first through hole and is exposed in the heating chamber for being inserted into the cigarette to heat the cigarette; and a fixing seat, wherein the fixing seat is connected to the bracket and arranged within the fixing seat compartment, wherein the fixing seat contacts the lower side of the partition wall, and the fixing seat abuts against the fixing part so as to fix the heating body on the bracket, wherein a second through hole is provided in the fixing seat and wherein the heating part extends through the second through hole which is aligned with the first through hole;

wherein the fixing seat comprises a first fixing seat and a second fixing seat, the first fixing seat comprises a first body and a first cylinder, the second fixing seat comprises a second body and a second boss, wherein the second boss of the second fixing seat extends upward from an upper surface of the second fixing seat along the longitudinal direction of the bracket, wherein the first cylinder extends from the first body in the longitudinal direction toward the second body, wherein the second boss extends into the first cylinder, and wherein the fixing part of the heating body is clamped between the first body and the second boss of the fixing seat, wherein a lower surface of the first body within the cylinder abuts against the upper surface of the fixing part and an upper surface of the second boss abuts against the lower surface of the fixing part, wherein the second through hole is provided in the first body.

10. The low-temperature baking smoking set according to claim 9, wherein an accommodating groove is concavely provided from the surface where the second boss is attached to the fixing part toward the direction away from the fixing part, the heater further comprises a temperature sensor provided in the accommodating groove, and the temperature sensor is in contact with the fixing part for detecting the real-time temperature of the heating body.

11. The low-temperature baking smoking set according to claim 9, wherein the fixing part is flat, and the plate surface of the fixing part is perpendicular to the longitudinal direction of the bracket.

12. The low-temperature baking smoking set according to claim 9, wherein the first body is clamped between the partition wall and the second boss, at least one clamping groove is provided on the outer side of the bracket, wherein at least one clamping protrusion matched with the clamping groove is convexly provided on the outer side of the second body.

13. The low-temperature baking smoking set according to claim 12, wherein the second body is concavely provided with an annular receiving groove, the receiving groove surrounds the second boss, wherein a lower end of the first cylinder is received in the receiving groove.

14. The low-temperature baking smoking set according to claim 13, wherein a second guide column extending along the longitudinal direction of the bracket is convexly provided on the outer side of the second boss, and a second guide groove matched with the second guide column is concavely provided on the inner side of the first cylinder.

15. The low-temperature baking smoking set according to claim 12, wherein an annular sealing groove is concavely provided on an end face of the first body abutting against the partition wall, the heater further comprises a sealing ring, and the sealing ring is received in the annular sealing groove.

16. The low-temperature baking smoking set according to claim 10, wherein a first limiting part and a second limiting part which are ring-shaped are convexly provided on the outer side of the bracket, and the heater further comprises a coil positioned between the first limiting part and the second limiting part.

* * * * *